US006435698B1

(12) United States Patent
Schneider

(10) Patent No.: US 6,435,698 B1
(45) Date of Patent: Aug. 20, 2002

(54) ROTARY LIGHTING SYSTEM

(76) Inventor: Enrico Schneider, Wasserstrasse 11, CH-4056 Basel (CH)

( * ) Notice: Subject to any disclaimer, the term of this patent is extended or adjusted under 35 U.S.C. 154(b) by 0 days.

(21) Appl. No.: 09/647,182

(22) PCT Filed: Mar. 24, 1999

(86) PCT No.: PCT/CH99/00126

§ 371 (c)(1),
(2), (4) Date: Sep. 27, 2000

(87) PCT Pub. No.: WO99/50122

PCT Pub. Date: Oct. 7, 1999

(30) Foreign Application Priority Data

Mar. 27, 1998 (CH) ..... 0725/98

(51) Int. Cl.[7] ..... F21S 9/00

(52) U.S. Cl. ..... 362/233; 362/286; 362/418; 362/404; 362/239

(58) Field of Search ..... 362/233, 285, 362/286, 418, 147, 404, 250, 239, 238

(56) References Cited

U.S. PATENT DOCUMENTS 4,312,276 A * 1/1982 Cory et al. ..... 104/38
5,347,431 A * 9/1994 Blackwell et al. ..... 362/11
5,672,003 A * 9/1997 Shemitz et al. ..... 362/396
6,170,967 B1 * 1/2001 Usher et al. ..... 362/394

* cited by examiner

*Primary Examiner*—Sandra O'Shea
*Assistant Examiner*—Ronald E. DelGizzi
(74) *Attorney, Agent, or Firm*—Sidley Austin Brown & Wood, LLP

(57) ABSTRACT

The invention relates to a rotary device for use for lighting systems which ensure flexible and, if required, even mobile illumination of a room, for example of a television studio. The rotary device according to the invention is mounted at intersections of a transport rail system for conveying transport units, for example lamps. It has two components which can be rotated relative to one another and of which one is in the form of a pivot bearing, serving for fastening at the intersection, for the other, while the other is a rail support containing at least one rail section. According to the invention, each rail section of the rail support is provided with contact tracks so that the transport unit present on the rail section and having current collectors can obtain energy.

5 Claims, 3 Drawing Sheets

ROTARY LIGHTING SYSTEM

FIELD OF THE INVENTION

The present invention relates to a rotary device for mounting at intersections of a transport rail system comprising transport units. It serves for guiding the transport units to the transport rails running in any direction and for simultaneously ensuring the supply of power and of control signals to the transport units. Mounted on the transport units are, for example, lamps which are supplied with energy and possibly control signals by the transport units and thus ensure flexible and, if required, even mobile illumination of a room, for example a television studio.

DESCRIPTION OF THE PRIOR ART

Conventional lighting systems for television studios, theater stages or the like have, for example, spotlights which are mounted on a transport rail system present on the ceiling and comprising turntables and can be manually positioned on the rails. Supply boxes from which a positioned spotlight can be supplied with power and control signals are mounted at regular intervals on the ceiling. However, such an arrangement requires relatively early and manual preparation for the event for which the lighting system is to be used and makes flexible, short-term adaptation of the lighting situation more difficult.

Another system for a lighting system envisages mounting a large number of spotlights which are adjustable only in height, it being possible, depending on requirements, to use those spotlights which are located in the suitable place. Only the height of the spotlights can be freely chosen. Although this system permits flexible work, it requires large investments in expensive spotlight systems and considerably limits the number of systems from which a spotlight can be used.

Yet another system is based on a transport rail system which can be installed in the ceiling structure of a studio. Thus, a transport rail system has rails which are parallel to one another and run over the entire length of the region in which spotlights are to be used. In each case a plurality of rail sections whose direction of travel is perpendicular to the direction of travel of the rails are mounted displaceably on a pair of such rails. The spotlights are fastened to transport units which can be pushed onto the rail sections. Two rail sections on adjacent pairs of rails can then be brought into position so that they are flush with one another and a transport unit of a spotlight can be moved from one rail section to the next. In this way, a spotlight can in principle be brought to any desired position on the ceiling. however, such a system has the substantial disadvantage that the transport distances on the rail system are long and inconvenient if the lighting system has a relatively large number of spotlights which possibly also are of various design and perform various functions, since rail sections occupied by transport units hinder one another during changes of position.

SUMMARY OF THE INVENTION

It is the object of the present invention to permit a lighting system which does not have the disadvantages of the systems described above and in which the lamps can be flexibly moved even while they are in use.

The invention relates to a rotary device, namely a rotary device for mounting at intersections between stationary transport rails which are provided with contact tracks and form part of a transport rail system for conveying transport units, the rotary device having two components which are rotatable relative to one another and of which one is in the form of a pivot bearing for the other, which rotary bearing serves for fastening at the intersection, while the other is a rail support containing at least one rail section. In the device according to the invention, each rail section of the rail support is provided with contact tracks so that a transport unit present on the rail section and having a current collector can obtain energy.

Furthermore, the invention also relates to a lighting system comprising lamps for illuminating television studios, theater or concert stages or the like, wherein the lamps are provided with transport units which can be positioned on a transport rail system comprising transport rails having contact tracks, these transport units having current collectors which make contact with the contact tracks, and wherein one rotary device as described above is present at each of the intersections of this transport rail system.

BRIEF DESCRIPTION OF THE DRAWINGS

An embodiment of the invention is explained below with reference to a drawing. In the drawing.

DESCRIPTION OF THE PREFERRED EMBODIMENTS

Figure 1:
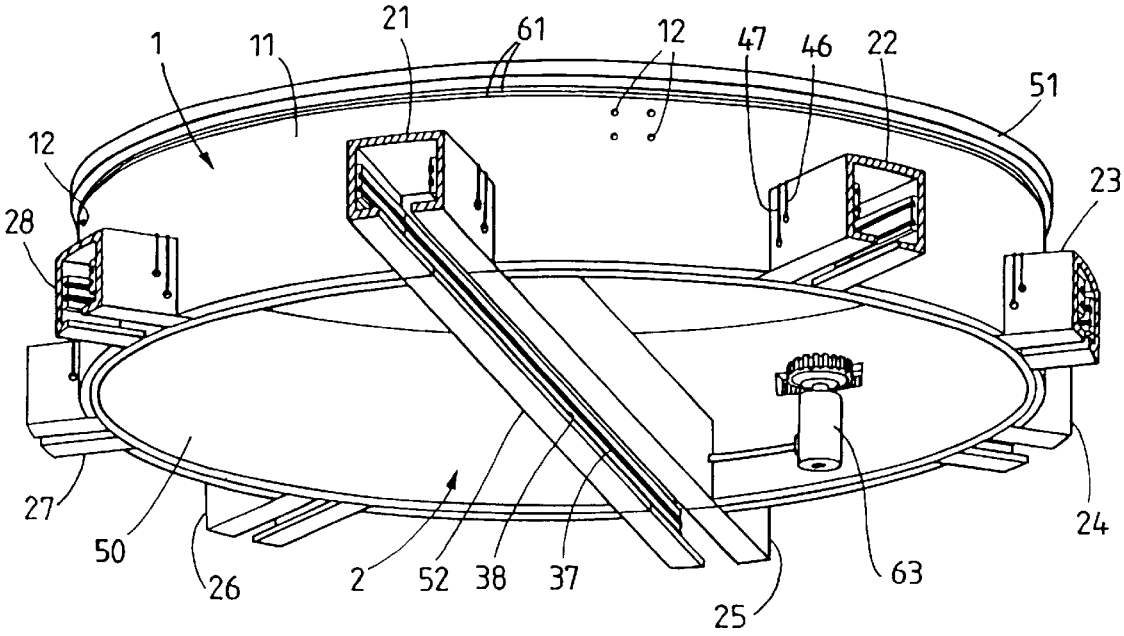
FIG. 1 shows a perspective view of a rotary device according to the invention.

As shown in FIG. 1, the rotary device consists of two components, of which one in the form of a pivot bearing, denoted as a whole by 1 and to be installed firmly at intersections of the transport rail system, for the other, denoted as a whole by two, and referred to below as rail support.

The pivot bearing 1 essentially comprises a hollow cylinder 11 having an external diameter $D_a$ and an internal diameter $D_i$. This is provided with threaded holes 12 which can be engaged by fastening means in order to fasten the rotary device to a ceiling or to a scaffolding. Depending on the structure of the transport rail system, for example, eight rail attachments 21, 22, 23, 24, 25, 26, 27, 28 of stationary transport rails are fixed to the cylinder 11 and are led radially outward from the cylinder surface, in each case two adjacent attachments making an angle of 45° with one another.

The rail support 2 likewise essentially comprises a hollow cylinder 50 whose external diameter $d_a$ is slightly less than the internal diameter $D_i$ of the hollow cylinder 11 belonging to the pivot bearing 1. It is additionally provided at the top with a flange 51 having an external diameter $d_f$ which is at least equal to $D_a$. Mounted in the lower part of the rail support is a rail section 52 which runs along a diagonal of the cylinder 50.

Each of the rail attachments 21 to 28 as well as the rail section 52 are symmetrical with respect to a plane which runs along the rail direction and is vertical in the example shown. Each rail attachment 21 to 28 or each rail section 52 has a ceiling 31, two side walls 32, 33 and two runways 34, 35. A transport unit 70 in the form of a trolley is displaceable on the runways 34, 35, along the direction of travel of the rail. A plastics band 36 is mounted on each of the two side walls 32, 33 of the rails. Each of the plastics bands is provided with at least two grooves, each of which contains a current-carrying rail 37 or 38 which is opened toward the inside of the rail and serves as a contact track. Those contact tracks 37, 38 of the rail attachments 21 to 28 which are opposite one another make contact with one another via connections 46, 47. The connections 46, 47 can be, for example, in the form of current-carrying cables mounted on the outside of the rail attachments 21 to 28, which cables make contact with the contact tracks 37, 38 through orifices in the side walls 32, 33.

Also mounted in the interior of the hollow cylinder 11 of the pivot bearing 1 of the rotary device is a plastics band 41 with inserted current-carrying rails 42, 43 which are connected directly to the current-carrying rails 37, 38 of the rail attachments 21 to 28. The rail support 2 has contact pins 44, 45 which are connected to the contact tracks 37, 38 of the rail section 52 and, in the state ready for operation, are pressed, for example by a spring, against the current-carrying rails 42, 43 so that they make electrical contact with them.

Figure 2:
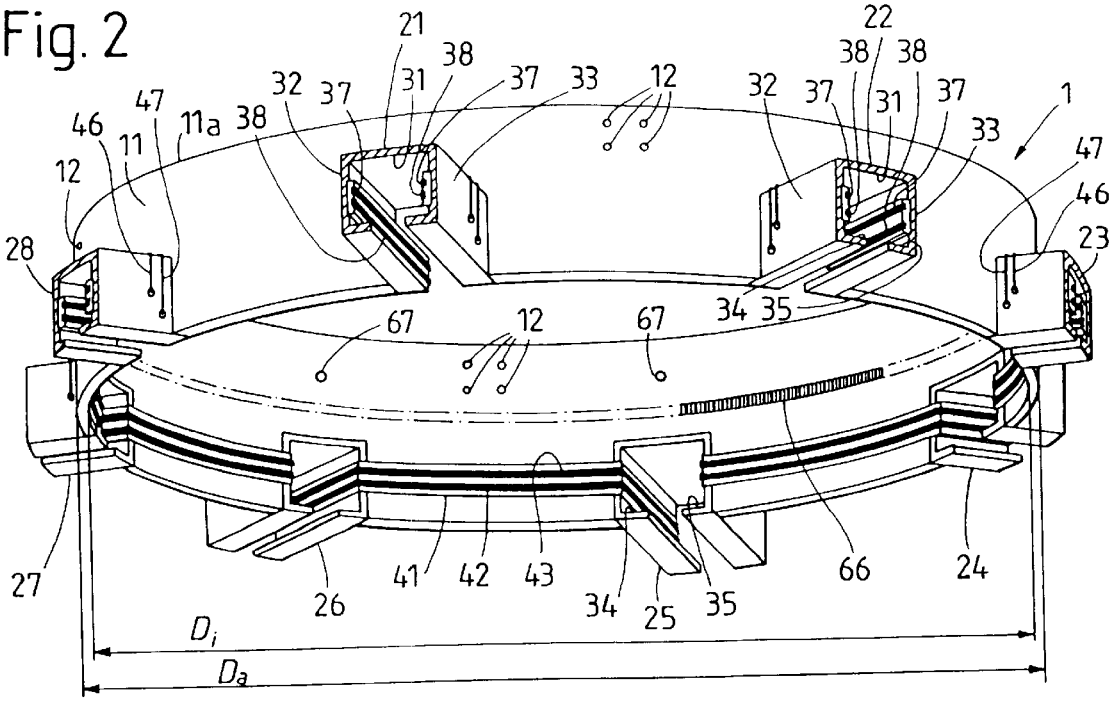
FIG. 2 shows a perspective view of the pivot bearing of this device.
Figure 3:
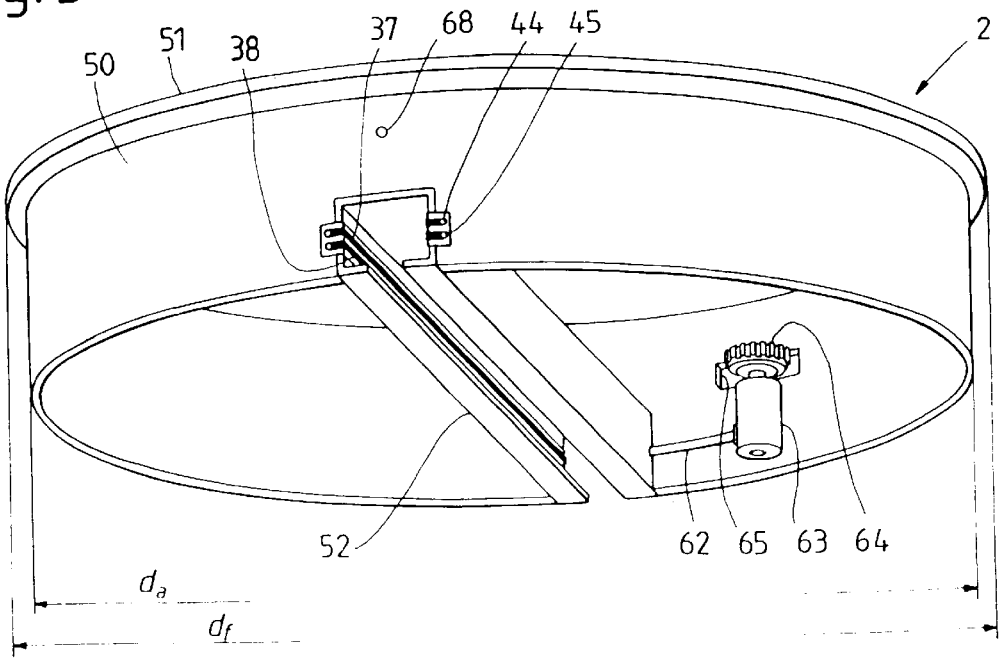
FIG. 3 shows a view, also a perspective one, of its rail support.
Figure 4:
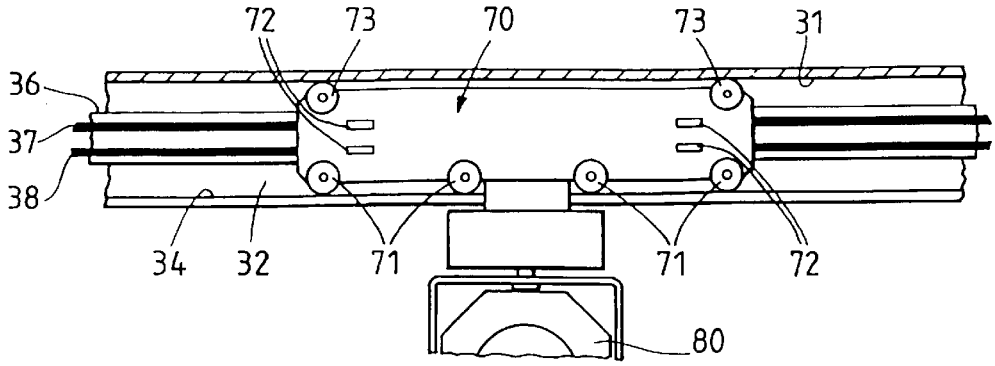
FIG. 4 shows a longitudinal section through the rail section of the rail support with mounted trolley shown uncut and FIG. 5 shows a perspective view of a part of a lighting system which is provided with rotary devices according to the invention, with a lamp shown schematically.

The trolley 70 shown schematically in FIG. 4 has a plurality of axles with wheels 71 running on the runways 34, 35, and drive means by which it can be moved along the rail. Current collectors 72 which slide along the contact tracks 37, 38 are mounted on that side of the trolley 70 which faces the observer in FIG. 4. In the embodiment shown in FIG. 2, the trolley 70 has one set of current collectors each at the front and rear in the direction of travel, only two current collectors 72 being present per set, corresponding to the number of contact tracks 37, 38. However, the number of current collectors does of course increase with the number of contact tracks 37, 38, if more than two of these are present. In addition, the trolley also has wheels 73 which are mounted at its top and, by running on the ceiling 31, prevent the trolley 70 from rearing up at large accelerations and the current collectors from losing contact with the current-carrying rails 37, 38.

In the state ready for operation, the rail support 2, as shown in FIG. 1, is inserted into the pivot bearing 1 of the rotary device. Present between the flange 51 and the upper edge 11*a* of the cylinder 11 is a roller bearing 61 which makes it possible for the rail support 2 to be turned with little resistance against the pivot bearing 1. For this purpose, the rail support 2 has an actuator. An electric motor 63 connected via supply cables 62 to the current-carrying rails 37, 38 of the rail section 52 is fastened to the inside of the rail support 2. If required, said motor produces a rotation of the rail support via a plastics gear wheel 64 which engages, through an orifice 65 in the cylinder 50, the teeth of a plastics toothed rack 66 countersunk in the inner surface of the cylinder 11. In addition, spherical indentations 67 are provided at predetermined positions at an angular spacing of 45° relative to one another on the inside of the hollow cylinder. A ball 68 is mounted on the outside of the cylinder 50 and is pressed outward by a spring against a stop or, in the state ready for operation, against the inside of the cylinder 11. It then snaps into one of these indentations when the rail support is aligned in such a way that one of the rail attachments 21 to 28 is in the direction which leads radially outward from its rail section 52. In this way, the positions in which a transport unit can be moved onto the rail support 2 or away from it are defined as fixed positions of the rail support 2.

Figure 5:
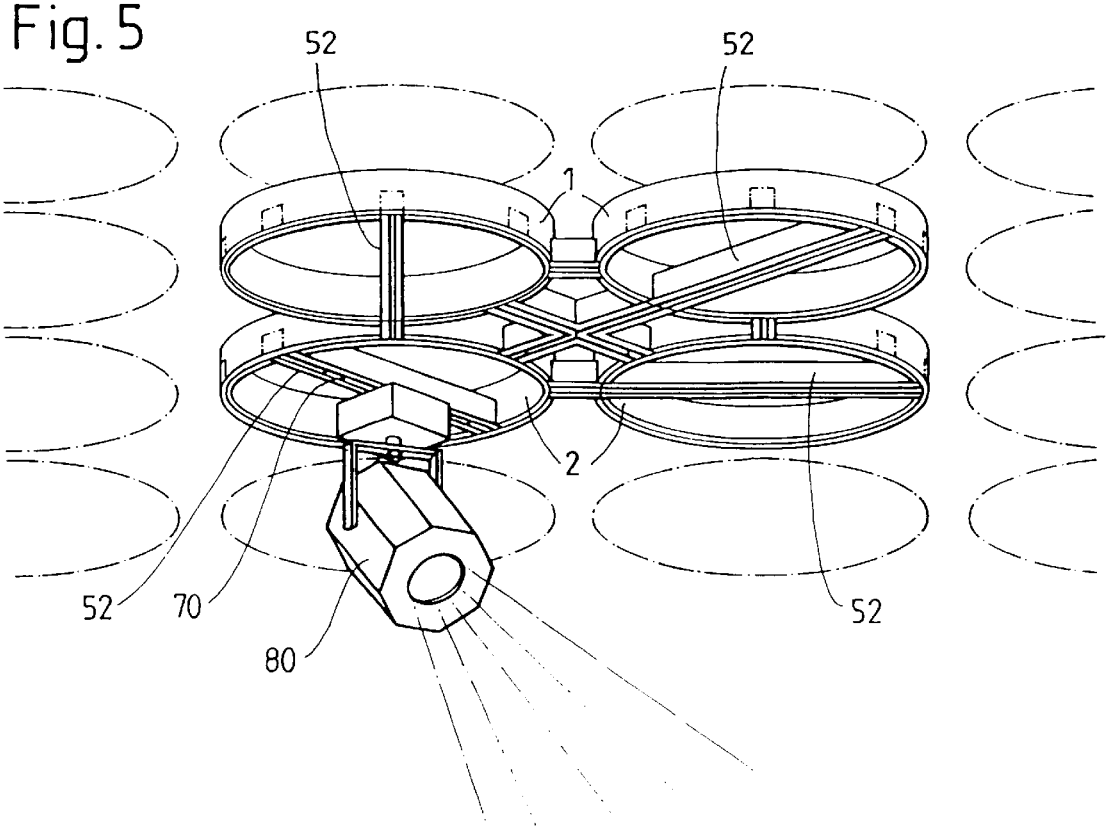

The structure and the mode of operation of a lighting system provided with rotary devices according to the invention are described briefly below. FIG. 5 shows a view of a part of such a lighting system comprising a lamp 80 shown only schematically. The lamp 80 is, for example, a spotlight having a set of color filters and a device for inserting a filter from this set. As is known for traditional lighting systems, it is provided with means by which its height can be adjusted and by which its light can be thrown in any desired direction.

The spotlights, together with the device for inserting the color filters, are supplied with power via the contact tracks and via the trolley 70. For feeding current and, depending on requirements, control signals into the contact tracks 37, 38, 42, 43 of the transport rail system, one of the rails installed in a fixed position is in contact with cables which are connected to a power unit and, if required, control devices. The contact tracks 42, 43 of the pivot bearing 1, together with the connections 46, 47, which connect together the opposite contact tracks 37, 38 of the stationary rails, and with the connections to the rail sections 52 of the rail support 2 via the contact pins 44, 45, ensure that the entire rail network is continuously connected to power units and control devices, subdivision into sectors which in each case have a separate power supply also being possible in the case of relatively large lighting systems. In this case, the trolley of each transport unit, as shown in FIG. 4, has two sets of current collectors one behind the other in the direction of travel and a relay circuit which switches back and forth between the two current collector sets to prevent a trolley from short-circuiting two sectors with one another.

The lighting system also has a central control unit not shown in the drawing. With the aid of this control unit, the position and current function of each spotlight can be continuously adapted to the requirements according to a predetermined program or by direct operation. The actuation of the spotlights, of the devices for inserting the color filters, of the trolleys and of the actuators by the control unit is then effected either by a control signal modulated on the power supply, via additional contact tracks for control signal transmission which are not shown in the drawing and are parallel to the current-carrying rails 37, 38 shown or via an infrared remote control.

The continuous power and control signal supplied to the spotlight independently of their position make it possible for them to change their position even during use, permitting novel and spectacular lighting effects during performances, for example at rock concerts. However, because the rotary device according to the invention is provided with an actuator with quiet force transmission via a plastics gear wheel, a lamp can be readily moved, for example in television studios during a broadcast, ensuring greater flexibility in comparison with conventional lighting systems and in particular permitting work with fewer spotlights.

Finally, it should also be mentioned that the rotary device described above is by no means the only possible embodiment of the invention and can also be modified in many respects. Thus, for example, it is entirely possible for the entire power supply to operate on the basis of three-phase current, in which case the number of contact tracks 38, 39 would of course correspondingly increase.

It is also entirely possible for a rail support 2 to have more than one rail section 52. If, for example, two intersecting rail sections making an angle of 90° with one another are mounted on each rail support 2, the maximum angle through which the rail support has to be turned before a transport unit 70 can be moved from a predetermined stationary rail onto one of its rail sections can be reduced to 45°. In this way, the speed with which the positions of the transport units 70 can be adapted can additionally be increased.

It is of course also possible for the structure of the transport rail system to differ from the embodiment shown schematically in FIG. 5. The rotary device can be installed, for example, in such a way that one rotary device is directly adjacent to the next one, so that the transport units can travel directly from one rail support 2 to the next one without having to travel over fixed rails. In this case, the pivot bearing 1 would of course have not eight rail attachments 21 to 28 but, for example, only four thereof, which would run in the diagonal directions of the transport system.

It is not only lamps which are suitable transport units. For example, it is also entirely possible for television cameras, loudspeaker boxes, etc. by themselves or in combination with lamps to be positioned in a flexible and mobile manner on a transport rail system provided with the rotary devices according to the invention.

The rotary device is of course also suitable for applications other than for the entertainment sector, for example for use for program-controllable transport devices in a warehouse.

What is claimed is:

1. A rotary lighting system, comprising at least one lamp-carrying transport unit; a rail support having at least one rail section for receiving the at least one lamp-carrying transport unit; and a pivot bearing for rotatably receiving the rail support, wherein the at least one rail section has contact tracks, wherein the lamp-carrying transport unit has current collectors cooperating with the contact track for communicating current to the at least one lamp-carrying transport unit, and wherein the rail support has contact pins for connecting the contact tracks of the at least one rail section with a power source, whereby power is fed to the at least one lamp-carrying transport unit.

2. A rotary lighting system has claimed in claim 1, further comprising an actuator for rotating the rail support, and means for fixing the rail support in predetermined positions.

3. A rotary lighting system as claimed in claim 2, wherein both the rail support and the pivot bearing are formed as hollow cylinders, and wherein the rail support-forming hollow cylinder is rotatably received in the pivot bearing-forming hollow cylinder.

4. A rotary lighting system as claimed in claim 3, wherein the actuator includes an electric motor secured to an inner surface of the rail support-forming hollow cylinder, and a gear wheel secured on an output shaft of the electric motor and projecting through an opening, which is formed in a wall of the rail support-forming hollow cylinder for engaging a toothed rack provided in an inner surface of the pivot bearing-forming, hollow cylinder, whereby the rail support is rotated upon actuation of the electric motor.

5. A rotary lighting system as claimed in claim 1, further comprising means for displacing the at least one lamp-carrying transport unit during use of the lamp.

* * * * *